United States Patent [19]

Kato

[11] Patent Number: 4,592,499

[45] Date of Patent: Jun. 3, 1986

[54] APPARATUS FOR DISPENSING FASTENERS

[75] Inventor: Masami Kato, Nagoya, Japan

[73] Assignee: Toska Co., Ltd., Tokyo, Japan

[21] Appl. No.: 680,122

[22] Filed: Dec. 10, 1984

[30] Foreign Application Priority Data

Apr. 12, 1984 [JP] Japan ..... 59-71729

[51] Int. Cl.[4] ..... B65C 5/06

[52] U.S. Cl. ..... 227/67; 227/116; 227/115; 227/136

[58] Field of Search ..... 227/67, 116, 136, 138, 227/114, 115

[56] References Cited

U.S. PATENT DOCUMENTS

| | | | |
|---|---|---|---|
| 2,783,468 | 3/1957 | Schwartz | 227/116 |
| 3,103,666 | 9/1963 | Bone | 227/67 |
| 3,650,451 | 3/1972 | Weiland et al. | 227/67 |
| 3,924,788 | 12/1975 | Furutu | 227/67 |
| 4,402,446 | 9/1983 | Suzuki | 227/67 |
| 4,417,656 | 11/1983 | Kato | 227/67 X |

*Primary Examiner*—Robert L. Spruill
*Assistant Examiner*—Taylor J. Ross
*Attorney, Agent, or Firm*—Armstrong, Nikaido, Marmelstein & Kubovcik

[57] ABSTRACT

There is disclosed a fastener applying apparatus for applying fasteners to articles by passing each fastener severed from a fastener assembly through a hollow needle. This fastener applying apparatus includes an alignment passage in which the fastener assembly is loaded, a guide slot formed at the uppermost end of the alignment passage, means for feeding the fastener to be placed at the uppermost end of the fastener assembly to the guide slot and a force rod adapted to forcibly introduce a cross bar section of the fastener into a cross bar section guide passage positioned on the axis of the hollow needle by advancing the fastener placed at the uppermost end of the fastener assembly in the guide slot.

6 Claims, 19 Drawing Figures

APPARATUS FOR DISPENSING FASTENERS

BACKGROUND OF THE INVENTION

The present invention relates to the art of applying or dispensing fasteners.

A wide variety of methods and apparatus for applying fasteners have hitherto been proposed. Of these, it is known that U.S. Pat. No. 3,103,666, U.S. Pat. No. 3,650,451 and U.S. Pat. No. 3,924,788 are typical of patents showing such apparatus.

All of these apparatus employ a gear mechanism as means for feeding fasteners.

It is to be noted that a fastener assembly is generally constructed in a manner such that a multiplicity of fasteners are connected via connecting pieces to a common connecting rod in the form of the teeth of a comb.

Such fastener is also referred to as a tag pin.

Each fastener has a head section at one end of a filament section and a cross bar section at the other end thereof.

It is also to be noted that the fastener assembly is integrally formed of a synthetic resin such as nylon or the like.

Normally, the head section of the fastener is approximately 1.0 mm in thickness, 10 mm in length and 3.5 mm in width, whereas the cross bar section is approximately 1.0 mm in diameter and 10 mm in length.

The length of the filament section ranges from 7.0 mm to 125 mm, although it may vary depending upon usage.

Thirty-five to 100 fasteners are connected, at 1.2 mm to 2.0 mm intervals, via connecting pieces to a common connecting rod in the form of the teeth of a comb.

Accordingly, the fasteners are likely to be entangled with each other. In addition, the fastener assembly per se is bulky. Hence, there is a disadvantage that various difficulties are encountered in the course of packing or using them.

In order to eliminate the foregoing disadvantage, there is proposed a closely interconnected fastener assembly in which cross bar sections of adjacent fasteners are arranged in slightly spaced relation to each other or a contact fastener assembly in which substantially no space is left between the cross bar sections of the fasteners. (See U.S. Pat. No. 4,417,656)

For example, such contact fastener assembly is remarkably compact as compared with a conventional fastener assembly in which the fasteners are sparsely arranged, the length of which is two thirds to one half of that of a conventional fastener assembly on condition that the number of the fasteners is the same therebetween.

As mentioned above, since the distance between the adjacent fasteners is remarkably shortened in the closely interconnected fastener assembly or the fasteners are in contact with each other in the contact fastener assembly, the distance between the adjacent connecting pieces presented between corresponding fasteners and connecting rod is narrower than the pitch of the teeth of the gear in a feed means provided in a conventional fastener dispensing or tag attaching apparatus.

Accordingly, such feed means in conventional fastener applying apparatus is incapable of feeding the fastener assembly.

It should be mentioned that the construction of the closely interconnected fastener assembly or contact fastener assembly is such that the cross bar sections of the adjacent fasteners are directly connected with each other, thereby avoiding the connecting rod and connecting pieces for connecting this connecting rod with the cross bar sections of the fasteners.

The fastener dispensing apparatus of the present invention is directed to the latter, namely, the contact fastener assembly.

SUMMARY OF THE INVENTION

It is an object of the present invention to provide a method of and apparatus for dispensing fasteners which can sever a fastener from the remainder of a closely interconnected fastener assembly in which the distance between cross bar sections of adjacent fasteners is extremely narrow or a contact fastener assembly and dispense the fasteners.

That is, in accordance with the present invention, a method of applying fasteners to articles by passing each fastener severed from a fastener assembly through a hollow needle comprises the steps of advancing the fastener in its longitudinal direction so as to sever the same from the fastener assembly and of subsequently advancing the fastener in the same direction so as to position the cross bar section of the fastener on the axis of the hollow needle.

Also, in accordance with the present invention, apparatus for applying fasteners to articles by passing each fastener severed from a fastener assembly through a hollow needle comprises an alignment passage in which the fastener assembly is loaded, a guide slot provided at the uppermost end of said alignment passage, means for feeding the fastener to be placed at the uppermost end of the fastener assembly to said guide slot and a force rod adapted to forcibly introduce the cross bar section of the fastener into a cross bar section guide passage positioned on the axis of the hollow needle by advancing the fastener placed at the uppermost end of the fastener assembly in its longitudinal direction.

In accordance with the present invention as broadly stated above, fasteners are securely severed and applied one by one from a closely interconnected fastener assembly in which the cross bar sections of adjacent fasteners are closely interconnected, or a contact fastener assembly in which the cross bar sections of fasteners are in contact with each other.

Further, as a blade portion of a feed blade is adapted to be inserted between a cross bar section placed at the uppermost end of the fastener and the next successive cross bar section thereof, it does not take place that two or more fasteners become inserted into the guide slot.

Still further, principal components of the fastener applying apparatus in accordance with the present invention are in the form of a rod and neither gear nor a complicated mechanism for driving the same is employed therein, unlike a conventional apparatus. The internal construction of the fastener applying apparatus in accordance with the present invention is, thus, simple.

Accordingly, the fastener applying apparatus in accordance with the present invention is readily manufactured and assembled.

BRIEF DESCRIPTION OF THE DRAWINGS

Other features and advantages of this invention will become more apparent from the following detailed description taken in connection with the accompanying drawings, in which.

DETAILED DESCRIPTION OF THE PREFERRED EMBODIMENTS

Figure 1:
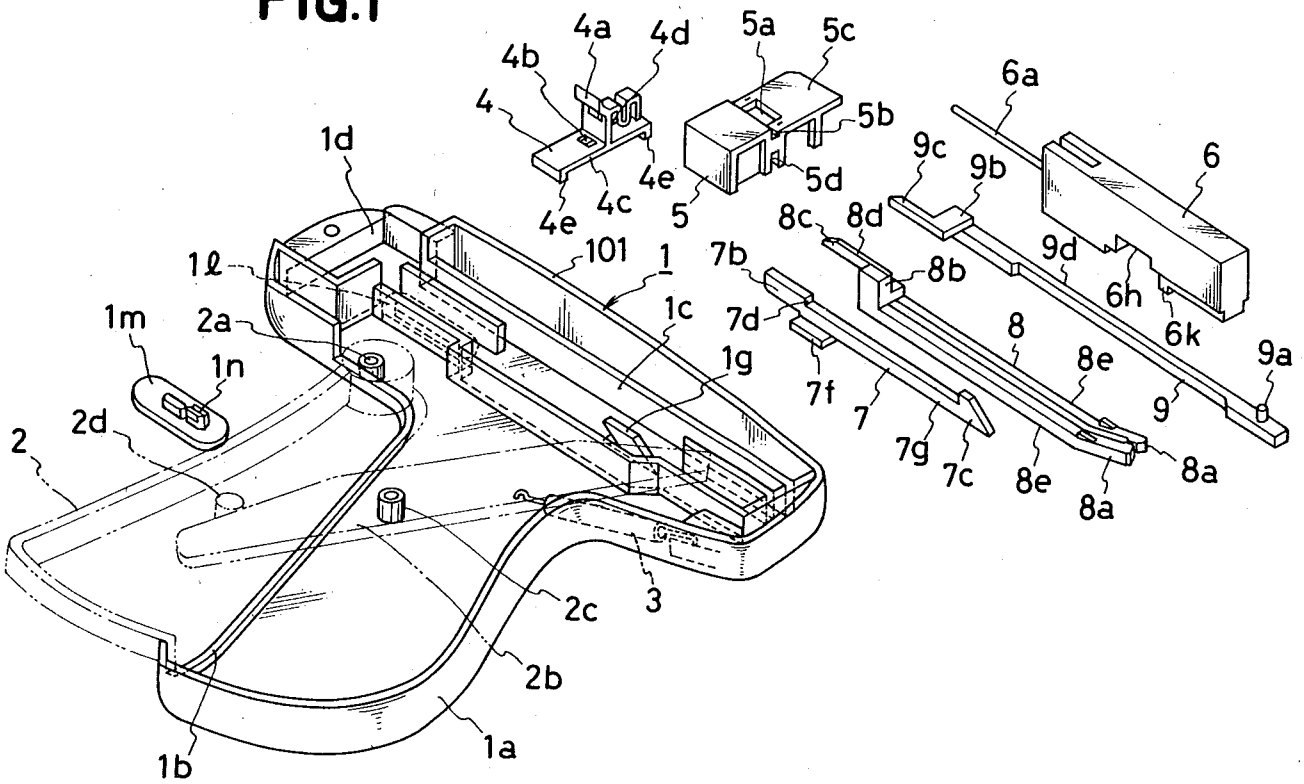
FIG. 1 is a exploded perspective view showing a right side body portion and the principal components of a fastener applying apparatus in accordance with the present invention.
Figure 2:
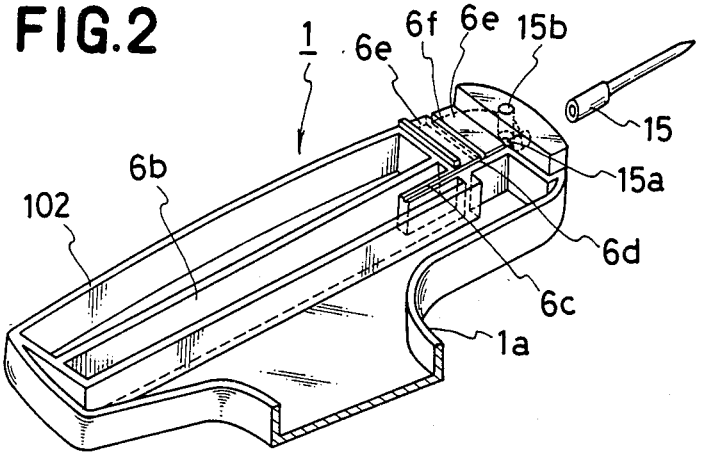
FIG. 2 is a perspective view of a left side body portion.

A fastener applying apparatus 1 has a pair of body sections 101, 102 as shown in FIGS. 1 and 2.

A lever is pivotally mounted to the body sections 101, 102 by a shaft 2*a*. An intermediate lever 2*b* is also mounted to a handle or grip portion 1*a* by a shaft 2*c*.

Provided between the intermediate lever 2*b* and the apparatus body 1 is a spring 3 by which the greater part of the lever 2 normally projects outwardly through an opening portion 1*b* of the handle portion 1*a*. At this time, the lower part of the intermediate lever 2*b* always urges a projection 2*d* provided in the lever 2.

Figure 5:
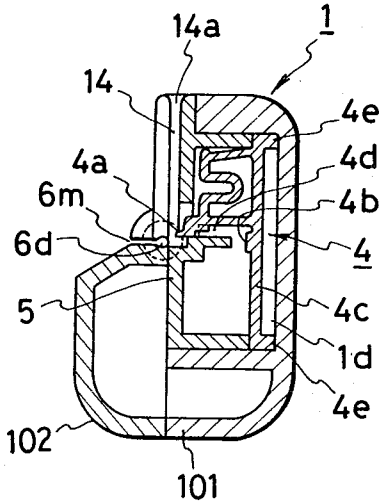
FIG. 5 is a sectional view taken along the line V—V in FIG. 4.

Further, as shown in FIG. 1, a feed mechanism loading portion 1*c* and a separation mechanism receiving portion 1*d* are respectively defined above the handle portion 1*a* in the apparatus body 1. This separation mechanism 1*d* is loaded with a feed blade 4 and a rest 5 as shown in FIG. 5.

Figure 3:
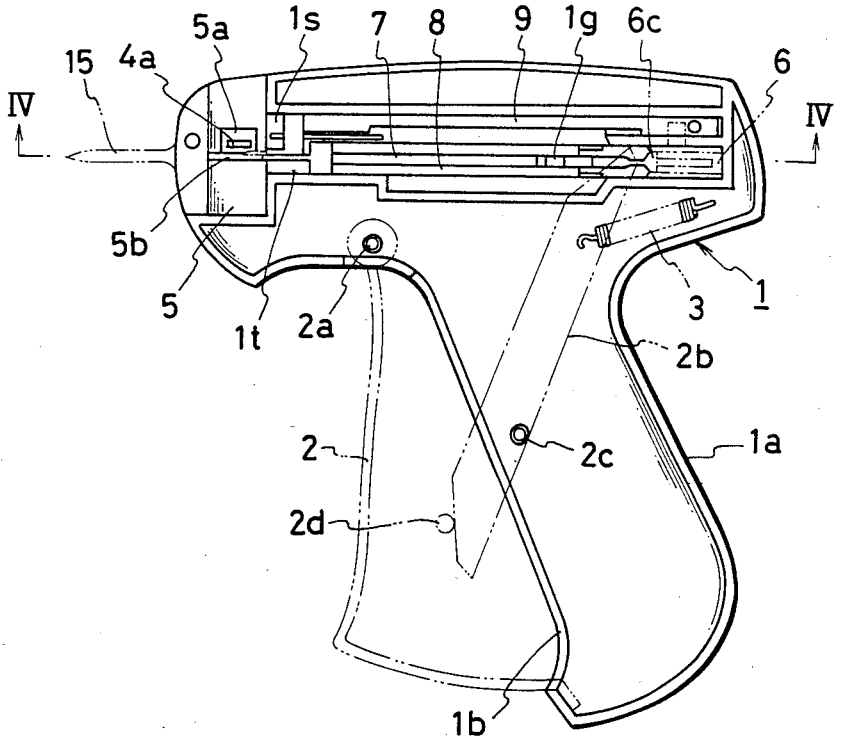
FIG. 3 is a front view showing the state in which the principal components are assembled in the right side body portion.

The feed mechanism loading portion 1*c* comprises an upper loading portion 1*s* and a lower loading portion 1*t* as shown in FIG. 3, and the feed blade displacement rod 9 is loaded in the upper loading portion 1*s*, whereas the feed blade driving rod 7 and the force rod 8 are loaded in the lower loading portion 1*t*. Further, the feed blade driving rod 7 is provided at the rear side of the force rod 8.

The rest 5 is formed with a guide surface 5*c* as shown in FIG. 1 which forms an alignment passage 14 with a guide surface 6*e* as will hereinafter be described. In addition, the rest 5 is formed at the bottom portion of the guide surface 5*c* with a guide slot 5*b* through which a cross bar engagement portion 8*c* of the force rod 8 is inserted.

In other words, the guide slot 5*b* is formed at the uppermost end of the alignment passage 14. Further, an opening portion 5*a* is so formed at the guide surface 5*c* as to communicate with this guide slot 5*b*. The blade portion 4*a* of the feed blade 4 is inserted into this opening portion 5*a* as shown in FIG. 5.

Additionally, the rest 5 has a slot 5*d* into which feed blade driving rod 7 and an operating portion 9*c* of the feed blade displacement rod 9 are inserted.

As shown in FIG. 1, the feed blade 4 is constructed of a spring portion 4*c* having at its both ends supports 4*e*, a leaf 4*d* projecting forwardly from said spring portion 4*c*, and a seat 4*b* provided at the spring portion 4*c*. The leaf 4*d* has the blade portion 4*a* at its front end.

On the other hand, the body section 102 is formed with a guide passage 6*b* for receiving the piston 6 as shown in FIG. 2. Formed in the forward portion of the guide passage 6*b* are a piston rod guide passage 6*c* and a cross bar section guide passage 6*d* connected to this piston rod guide passage 6*c*. Further, a filament section insert passage 6*f* is formed in a direction perpendicular to the cross bar section guide passage 6*d* and guide surfaces 6*e* are formed at both sides of the filament section insert passage 6*f* for the formation of the alignment passage 14.

The piston rod 6*a* of the piston 6 is reciprocated along the guide passage 6*c* and cross bar section guide passage 6*d*.

Formed in the forward direction of the cross bar guide passage 6*d* is a hole 15*a* in which a hollow needle 15 with a lateral slot is fitted. The front half of the cross bar section guide passage 6*d* and the lateral slot of the hollow needle 15 together constitute an opening 6*m* so as not to prevent passing of the filament section of the fastener as shown in FIG. 5. The hollow needle 15 is fixed to the body 102 by means of a stopper (not shown) mounted in the hole 15*b*.

Figure 9:
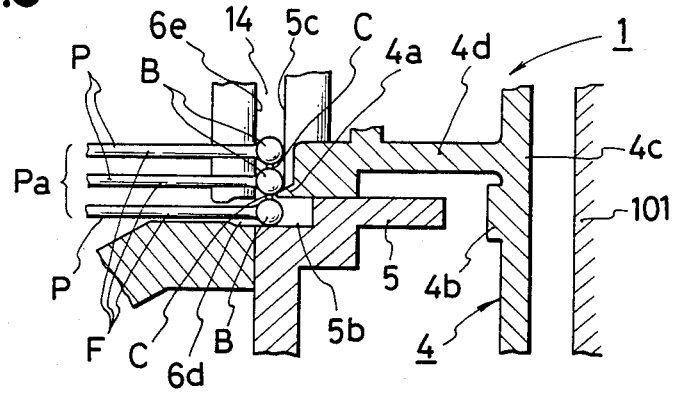
FIG. 9 is an enlarged view showing the principal part of FIG. 5.
Figure 12:
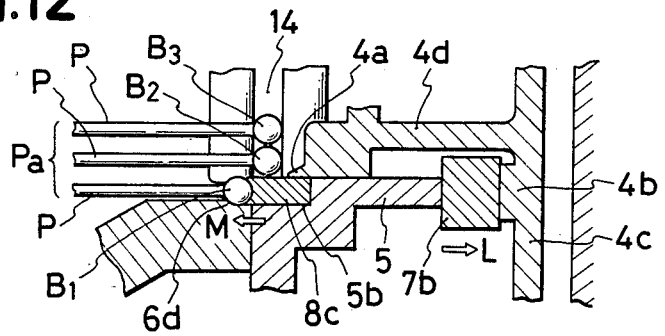
FIGS. 12, 13, 18 and 19 are views respectively showing the fastener applying apparatus in use.

As shown in FIG. 9, each fastener P includes a head section (not shown), a filament section F and a cross bar section B. The cross bar sections B are interconnected by means of respective connecting pieces C and the fasteners P are arranged in the form of the teeth of a comb so as to constitute a fastener assembly Pa. This fastener assembly Pa is integrally constructed of synthetic resin such as nylon or the like.

For convenience, an axial direction in the filament section F of the fastener P is referred to as a longitudinal direction in the fastener P.

The connecting pieces C are preferably as thin as possible so as to be readily severed. Further, the connecting pieces C are preferably as short as possible so that the cross bar sections B of adjacent fasteners P leaves substantially no space therebetween.

Figure 4:
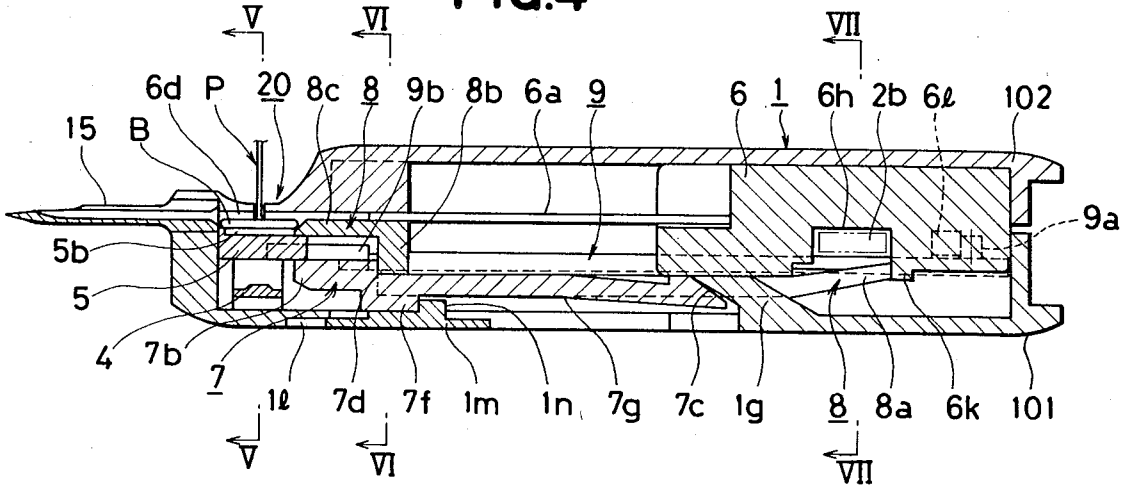
FIG. 4 is a sectional view taken along the line IV—IV in FIG. 3.
Figure 7:
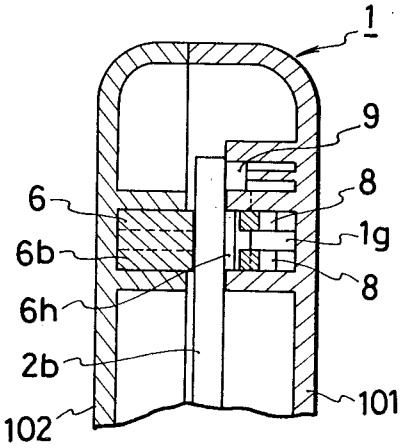
FIG. 7 is a sectional view taken along the line VII—VII in FIG. 4.
Figure 6:
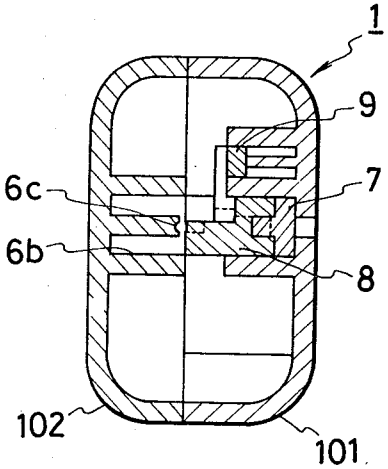
FIG. 6 is a sectional view taken along the line VI—VI in FIG. 4.

As shown in FIG. 7, the piston 6 is incorporated into the guide passage 6*b*. This piston 6 has a notch 6*h* for engagement with the upper portion of the intermediate lever 2*b* and also, an urging portion 6*k* extending from the rear surface of the notch 6*h* as shown in FIG. 4. In addition, a piston rod 6*a* projects forwardly from the piston 6.

The feed blade driving rod 7 is in the form of a thin and long rod and is provided at its front end with a feed blade driving portion 7*b*. Formed at the rear portion of this feed blade driving portion 7*b* is a stepped portion 7*d* for engagement with an upstand portion 8*b* of the force rod 8 as will hereinafter be described.

In addition, this feed blade driving rod 7 is provided at its rear end of a body portion 7*g* thereof with an engagement portion 7*c* in the form of a hook.

This engagement portion 7*c* of the feed blade driving rod 7 is normally in engagement with a pawl 1*g* provided on the body section 101 and is thereby bent backward as shown in FIG. 4.

The force rod 8 includes two body portions 8*e*, 8*e*. Formed at the rear end of each of the body portions 8*e*, 8*e* is a bent portion 8*a*. In addition, the force rod 8 is provided at its front end with a cross bar section engagement portion 8*c* via an upstand portion 8*b*. This cross bar engagement portion 8*c* serves to sever the fasteners P from the remainder of the fastener assembly Pa and is formed with a slot 8*d* in the form of a semicircle.

The feed blade displacement rod 9 is in the form of a thin and long rod as shown in FIG. 1 and is provided at the rear end of its body portion 9*d* with a projection 9*a* for engagement with a projection 6*l* provided in the piston 6. In addition, the feed blade displacement rod 9 is provided at its front end with an operating portion 9*c* via a plate portion 9*b* for engagement with the piston 6.

A feed means 20 comprises the blade portion 4*a* of the feed blade 4 for engagement with the cross bar sections B of the fasteners P, the feed blade driving rod 7 being inserted between the rest 5 forming the alignment passage 14 and the seat 4*b* of the feed blade 4 so as to disengage the blade portion 4*a* of the feed blade 4 from the cross bar section B of the fastener P against the force of the spring portion 4*c* of the feed blade 4, and the feed blade displacement rod 9 being inserted between the rest 5 and the blade portion 4*a* of the feed blade 4 so as to retreat the blade portion 4*a* of the feed blade 4 in the direction of an entrance 14*a* of the alignment passage 14 against the force of the leaf 4*d* of the feed blade 4.

(I) Application of Fasteners

In attaching tags to articles by means of the fasteners P, the fastener assembly Pa is loaded in the alignment passage 14 of the fastener applying apparatus 1 as shown in FIG. 9. More specifically, the cross bar sections B in the fastener assembly Pa are loaded in the alignment passage 14 of the fastener applying apparatus 1 from the entrance 14*a* thereof.

Next, the hollow needle 15 is passed through a hole of each tag and pushed through the article.

When the lever 2 is squeezed, the fastener P placed at the uppermost end of the fastener assembly Pa is severed therefrom and at the same time, the cross bar section B of the fastener P is pushed into the cross bar section guide passage 6*d*. The cross bar section B of the fastener P is, then, pushed out of the front end of the hollow needle 15 by means of the piston rod 6*a*. At this time, the cross section bar B of the fastener P and part of the filament section F pass through the tag and article so that the tag is attached to the article by the fastener P.

Operation of each component of the fastener applying apparatus 1 will now be described.

Figure 8:
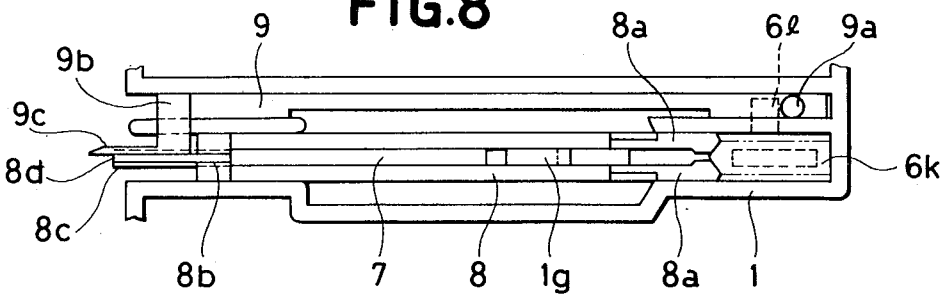
FIG. 8 is an enlarged view showing the principal part of FIG. 3.

The piston 6 is normally located at the uppermost end of the body portions 101, 102 as shown in FIGS. 4 and 8.

Figure 10:
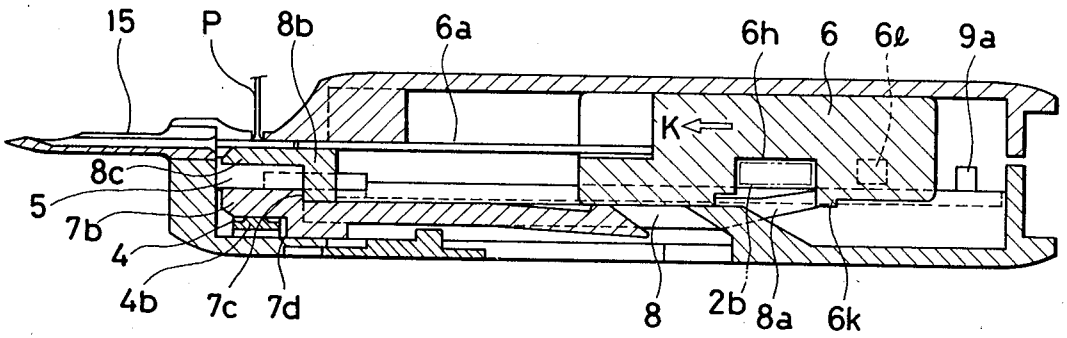
FIGS. 10, 11, 14, 15, 16 and 17 are views respectively showing the fastener applying apparatus in use, FIGS. 10, 14 and 16 corresponding to FIGS. 11, 15 and 17 respectively.

When the lever 2 is squeezed, the piston 6 advances in the direction of an arrow K by the intermediate lever 2*b* as shown in FIG. 10. The bent portion 8*a* of the force rod 8 is, then, pushed by the urging portion 6*k* of the piston 6. Further, the stepped portion 7*d* of the feed blade driving rod 7 is pushed by the upstand portion 8*d* of the force rod 8 whereby the force rod 8 and feed blade driving rod 7 advance together in the direction of the arrow K.

Next, when the feed blade driving portion 7*b* of the feed blade driving rod 7 is inserted between the seat 4*b* of the feed blade 4 and the rest 5 as shown in FIGS. 1 and 2, the spring portion 4*c* of the feed blade 4 retreats in the direction of an arrow L and simultaneously therewith, the blade portion 4*a* of the feed blade 4 retreats in the same direction.

On the other hand, when the cross bar section engagement portion 8*c* of the force rod 8 is inserted into the guide slot 5*b* provided in the rest 5 as shown in FIGS. 1 and 2, the fastener P at the uppermost end of the fastener assembly Pa is pushed out in its longitudinal direction as shown by an arrow M by means of this cross bar section engagement portion 8*c*. At this time, the connecting piece C between a cross bar section B1 of the fastener P at the uppermost end of the fastener assembly Pa and the next cross bar section B2 of the fastener is severed.

The cross bar section B1 of the fastener P severed from the fastener assembly Pa is, then, inserted into the cross bar guide passage 6*d*. In this state, the cross bar section B1 at the uppermost end of the fastener assembly Pa is positioned at the opening end of the hollow needle 15, namely, on the axis of the hollow needle 15 as shown in FIG. 10.

Figure 11:
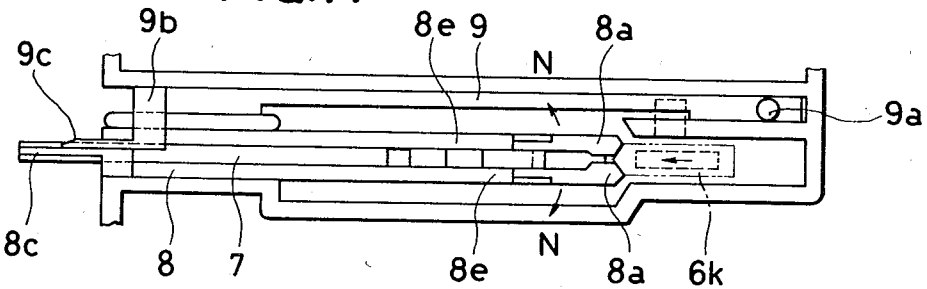

When advancement of the force rod 8 is prevented as a result of that the upstand portion 8*b* of the force rod 8 is in abutment with the rest 5 as shown in FIG. 10, the body portions 8*e*, 8*e* of the force rod 8 are opened in the direction of an arrow N so as to disengage the urging portion 8 of the force rod 8 as shown in FIG. 11.

Figure 13:
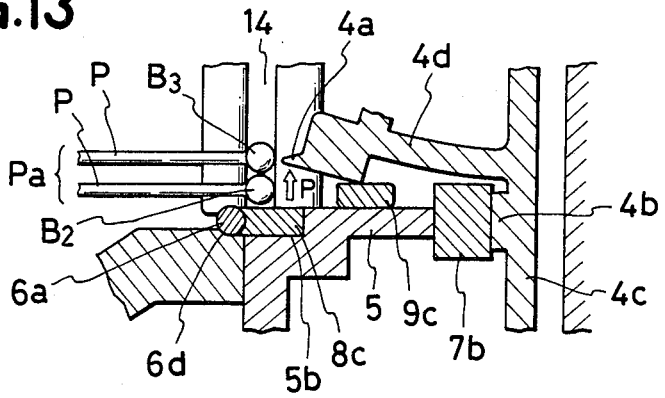

Further, when the piston 6 advances in the direction of the arrow K, the plate portion 9*b* of the feed blade displacement rod 9 is pushed by piston 6, so the operating portion 9*c* of the feed blade displacement rod 9 is inserted between the rest 5 and the leaf 4*d* of the feed blade 4 and the blade portion 4*a* of the feed blade 4 is, then, bent in the direction of an arrow P as shown in FIG. 13.

Figure 14:
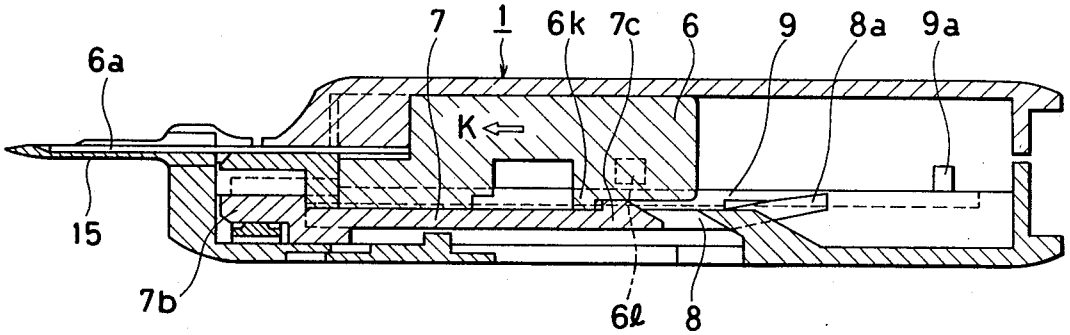
Figure 15:
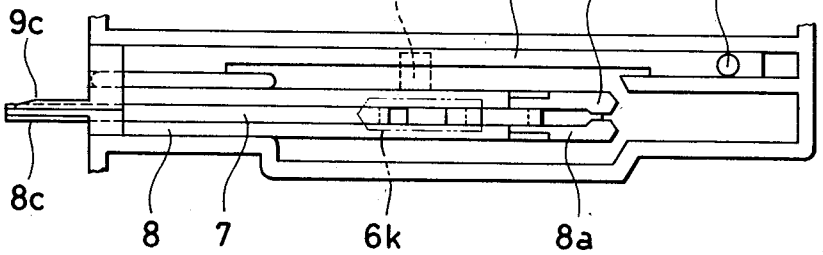

At the same time, the piston rod 6*a* mounted on the piston 6 advances into the hollow needle 15 as shown in FIG. 14 whereby the cross bar section B1 of the fastener P is pushed out of the front end of the hollow needle 15. At this time, the cross bar section B1 of the fastener P and part of the filament section F pass through the tag and article as has been described hereinabove.

In this state, the urging portion 6*k* of the piston 6 is positioned in the forward direction of the engagement portion 7*c* of the feed blade driving rod 7 as shown in FIG. 14.

(II) Return of the Piston

Figure 16:
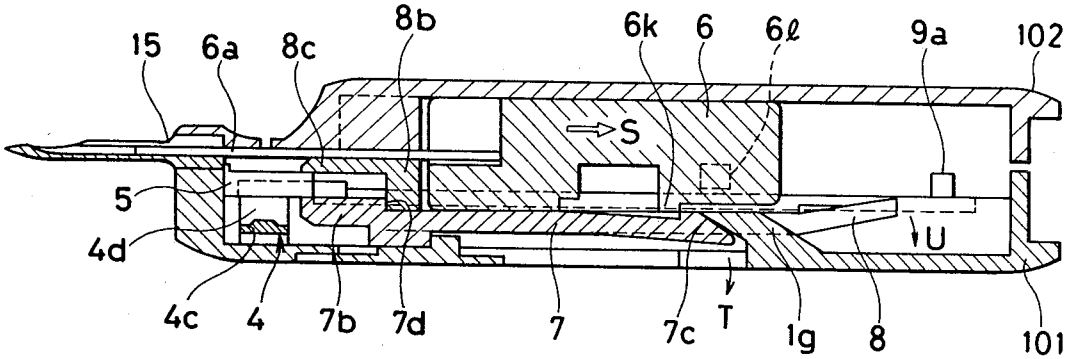
Figure 17:
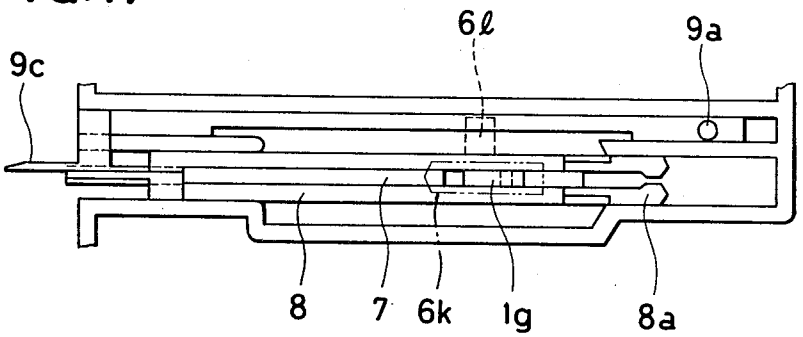

While the lever 2 is being released, the piston 6 retreats in the direction of an arrow S as shown in FIG. 16. Upon continued retreat of the piston 6, the urging portion 6*k* of the piston 6 is brought into engagement with the engagement portion 7*c* of the feed blade driving rod 7. Furthermore, the stepped portion 7*d* of the feed blade 7 is brought into engagement with the upstand portion 8*b* of the force rod 8 whereby the feed blade driving rod 7 and the force rod 8 together retreat in the direction of the arrow S.

Then, when the engagement portion 7*c* of the feed blade driving portion 7 comes into abutment with the pawl 1*g* provided on the body section 101, it is bent in the direction of an arrow T. Thus, the engagement portion 7*c* of the feed blade driving rod 7 is disengaged from the urging portion 6*k* of the piston 6.

Figure 18:
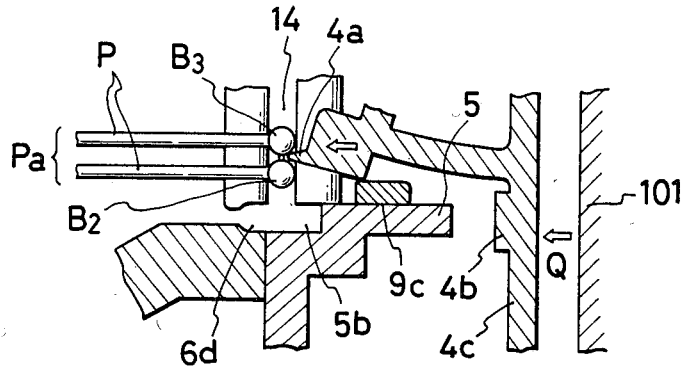

At this time, the cross bar section engagement portion 8*c* of the force rod 8 is pulled out of the guide slot 5*b* as shown in FIG. 18. At the same time, the feed blade driving rod 7 is also pulled out of the position between the rest 5 and the seat 4*b* of the feed blade 4. Then, the spring portion 4*c* of the feed blade 4 is returned in the direction of an arrow Q whereby the blade portion 4*a* is positioned between the second cross bar section B2 of the fastener P and a third cross bar section B3 thereof.

Figure 19:
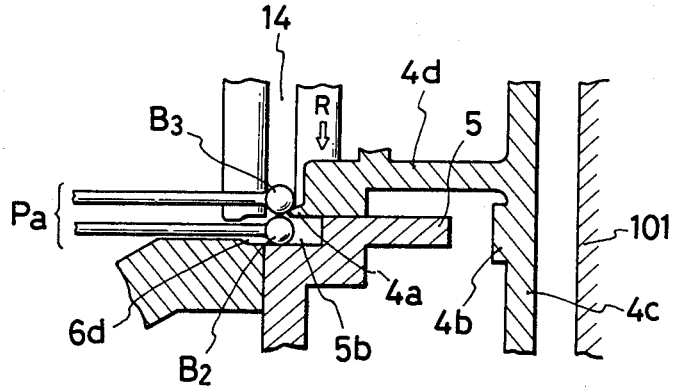

Further, upon retreat of the piston 6 in the direction of the arrow S, the projection 6*a* of the piston 6 comes into engagement with the projection 9*a* of the feed blade displacement rod 9, thereby moving the feed blade displacement rod 9 backward. As a result, the operating portion 9*c* of the feed blade displacement rod 9 is pulled out of the position between the rest 5 and the leaf 4*d* of the feed blade 4 as shown in FIG. 19 and the leaf 4*d* is, then, returned in the direction of an arrow R. While the leaf 4*d* is being returned in the direction of the arrow R, the fastener assembly Pa is also moved in the same direction whereby the second cross bar section B2 of the fastener P is pushed onto the bottom of the guide slot 5*b*.

It is to be noted that pushing of the bent portion 8*a* of the force rod 8 in the direction of an arrow U causes the piston 6 to be returned to its initial position as shown in FIG. 16.

(III) Unloading of the Fastener Assembly

There may be a case in which the fastener assembly Pa needs to be unloaded from the fastener applying apparatus 1 during its use.

The construction of means for releasing the feed blade 4 from the fastener assembly Pa is as follows:

As shown in FIG. 1, a long hole 1l is formed in the body section 101. A release plate lm is slidably mounted to the long hole 1l.

When this release plate 1*m* is moved forward, a projection 1*n* on the release plate is brought into engagement with a plate portion 7*f* of the feed blade driving rod 7 so as to advance the feed blade driving rod 7 as shown in FIG. 4. Then, the feed blade driving rod 7 is inserted between the rest 5 and the seat 4*b* of the feed blade 4 whereby the blade portion 4*a* of the feed blade 4 is disengaged from the fastener assembly Pa.

In this manner, the fastener assembly Pa may be unloaded from the alignment passage 14.

It is to be understood that the invention be not limited by the foregoing construction and that various changes and modifications be made in the invention within the scope as set forth in the appended claims.

What is claimed is:

1. Apparatus for applying fasteners (P) to articles by passing each fastener (P) severed from a fastener assembly (Pa) through a hollow needle (15), said fastener assembly comprising a plurality of fasteners and means for connecting the fasteners together, each fastener having a cross bar section, said apparatus comprising:

an alignment passage (14) in which the fastener assembly (Pa) is loaded, a guide slot (5*b*) located at and in communication with a bottom end portion of the alignment passage (14), feed means (20) comprising a feed blade (4) engageable with a cross bar section (B) of the fastener (P), a feed blade driving rod (7) for releasing engagement between the cross bar section (B) of the fastener (P) and the feed blade (4), and a feed-blade displacement rod (9) for retracting the feed blade (4) toward an open top end of the alignment passage (14), a force rod (8) adapted to sever fasteners (P) individually successively from the fastener assembly (Pa) while forcing the fastener (P) being severed in the longitudinal direction thereof and to push the cross bar section (B) of each severed fastener (P) into a guide passage (6*d*) located on the axis of the hollow needle (15), and a piston (6) having a piston rod (6*a*) for pushing out of a leading end of the hollow needle (15) the cross bar section (B) of the fastener (P) placed in the guide passage (6*d*).

2. The apparatus of claim 1, wherein said feed blade driving rod 7 is inserted between a rest 5 forming the alignment passage 14 and a seat 4*b* of the feed blade 4 so as to disengage the blade portion 4*a* of the feed blade 4 from the cross bar section B of the fastener P against the force of a spring portion 4*c* of the feed blade 4, and said feed blade displacement rod 9 is inserted between the rest 5 and the blade portion 4*a* of the feed blade 4 so as to move the blade portion 4*a* of the feed blade 4 backward in the direction of an entrance 14*a* of the alignment passage 14 against the force of the spring portion 4*d* of the feed blade 4.

3. The apparatus of claim 2, wherein an operating portion 9*c* is provided at the front end of the feed blade displacement rod 9 so as to move the blade portion 4*a* of the feed blade 4 backward in the direction of the entrance 14*a* of the alignment passage 14 by substantially one pitch of the cross bar section B of the fastener P.

4. The apparatus of claim 2, wherein said feed blade driving rod 7 comprises a feed blade driving portion 7*b* inserted between the rest 5 and the seat 4*b* of the feed blade 4, a stepped portion 7*d* for engagement with an upstand portion 8*b* of a force rod 8 and an engagement portion 7*c* for engagement with a pawl 1*g* provided in a body section 101.

5. The apparatus of claim 2, wherein said force rod 8 comprises a cross bar section engagement portion 8*c* inserted into the guide slot 5*b* formed at the uppermost end of the alignment passage 14 a stepped portion 8*b* for engagement with an upstanding portion 7*d* of the feed blade driving rod 7, two openable body portions 8*e* and bent portions provided at the end of each of the body portions 8*e* and for engagement with an urging portion 6*k* of the piston 6.

6. The apparatus of claim 2, wherein said feed blade displacement rod 9 comprises an operating portion 9*c* inserted between the rest 5 and the blade portion 4*a* of the feed blade 4, a plate portion 9*d* for engagement with the piston 6 and a projection 9*a* for engagement with an urging portion 6*k* of the piston 6.

* * * * *